United States Patent [19]

Lilja

[11] 4,081,933

[45] Apr. 4, 1978

[54] OUTER WALL ELEMENT

[76] Inventor: Pekka Juhani Lilja, Siilitie 5 B 10, 00800, Helsinki 80, Finland

[21] Appl. No.: 696,986

[22] Filed: Jun. 17, 1976

Related U.S. Application Data

[63] Continuation-in-part of Ser. No. 585,159, Jun. 9, 1975, abandoned.

[30] Foreign Application Priority Data

Jun. 19, 1974 Finland ..... 1880/74

[51] Int. Cl.[2] ..... E06B 7/12

[52] U.S. Cl. ..... 52/171; 52/616

[58] Field of Search ..... 52/220, 171, 616, 606, 52/607, 208, 209; 98/31, 88 R

[56] References Cited

U.S. PATENT DOCUMENTS

| | | | |
|---|---|---|---|
| 3,771,273 | 11/1973 | Brodie | 52/220 X |
| 3,925,945 | 12/1975 | White | 52/616 X |
| 3,982,475 | 9/1976 | Wild | 98/31 |

*Primary Examiner*—Ernest R. Purser
*Assistant Examiner*—Carl D. Friedman
*Attorney, Agent, or Firm*—Ladas, Parry, Von Gehr, Goldsmith & Deschamps

[57] ABSTRACT

An outer wall element comprising a concrete part and or heat insulation part. Inside the element has a continuous channel from end to end and of a width substantially corresponding to the width of the element. The space between the window glasses forms a part of the channel.

8 Claims, 10 Drawing Figures

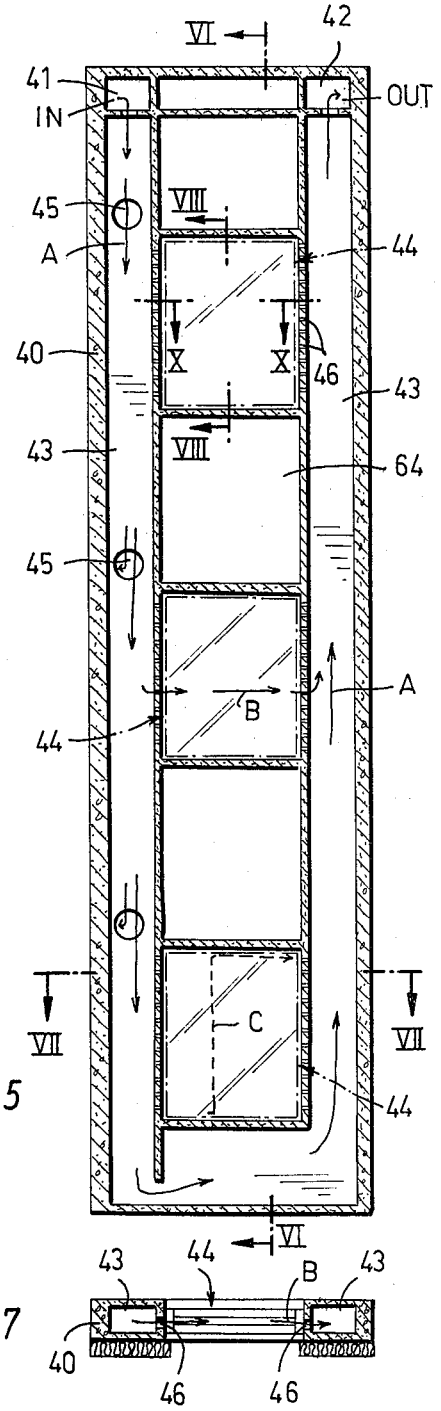
FIG. 5
FIG. 7
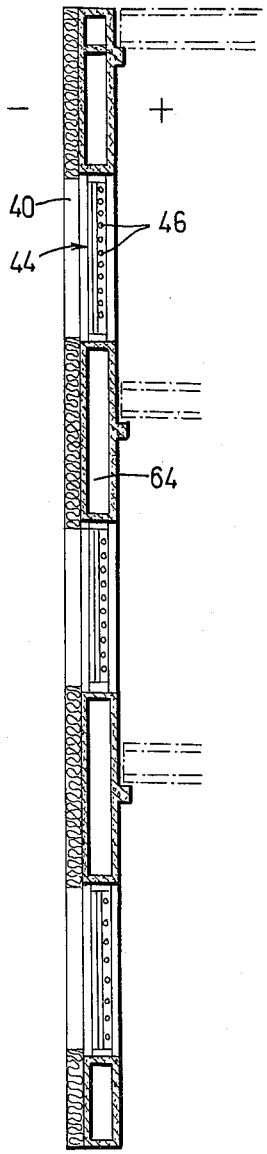
FIG. 6

OUTER WALL ELEMENT

This is a continuation-in-part of copending application Ser. No. 585,159 filed June 9, 1975 and now abandoned.

The present invention relates to an outer wall element provided with at least one opening for a double glass window and having a height of at least one story of the building and comprising a concrete part and a heat insulating part.

All electric cables, sewerage, ventilation and other corresponding installations can be installed in various elements during the factory manufacture.

From French Pat. Publications Nos. 1,202,814 and 1,277,434 it is previously known to circulate air in walls and floors. In the former publication is shown a wall construction constructed of perforated bricks permitting the circulation of warm and cold air inside the walls. Air is circulated in the solution also in the ceilings and floors. In the latter publication again is shown a feeble-constructed outer wall wherein inlet air is passing in one channel and outlet air in the other. The window again is a simple one glass turning window.

The constructions shown in the above mentioned publications have considerable disadvantages. The circulation of air in the walls and floors may in some sense bring satisfactory results, but the heat exchange taking place through the window has in these been nearly entirely overlooked. Especially in the northern latitudes heat lost through the windows represents a very sizeable share of lost energy. On the other hand, the window surfaces are in general the coldest surfaces in the rooms causing an unpleasant feeling of draft and often also requiring the maintenance of a relatively high temperature.

The above mentioned disadvantages are eliminated and an entirely new type of outer wall element structure is provided by the invention which is characterized in that it has a continuous channel running through the element from end to end of a width substantially corresponding to the width of the element, the space between the window glasses forming a part of the channel.

In a preferred embodiment the channel is arranged between the concrete part and the insulating part, the concrete part facing inwards to the building and the insulating part outwards to the air. Further, in each window there is preferably a single glass between the channel and the room air and a double glass of good heat insulating capacity between the channel and the outer air. In order to meet fire regulations all the window frames are fire protected and the upper and lower frames of the windows are provided with fire plates or the like.

The element may be used both in office buildings and the like as well as in living houses. In elements for office buildings the channel through the element is preferably formed as one single wide channel, functioning then very well both for heating and cooling purposes.

In ordinary living houses, where heating is a main problem, at least on northern latitudes, the channel may be divided into parallell vertical parts.

With the outer wall element according to the invention is a.o. achieved that all outer wall and window surfaces of the building are heat emitting surfaces. Due to this, the temperature of the building can be lowered as much as two to three degrees without any harm to the comfort of living. On the contrary, the relatively humidity of the indoor air increases quite considerably due to the lowered temperature.

Other advantages of the invention are:

improvement of indoor air conditions, since all surfaces will be evenly warn, improvement of energy economy, since the element can serve as a heat exchanger, and reduction of required cooling, since the cooling effect of the cold night air can be utilized by means of the mass of the structures.

Whether the room requires heating or cooling, the indoor air conditions will improve substantially. In the event of heating the temperature of the surfaces rises so that no radiating draft occurs even from the window. In the event of cooling, on the other, the difficult leading-in of the cooling effect can be partly handled by means of the radiation of the cold surfaces.

If the element is used as part of the exit air system, direct references of its function can be obtained from the widely studied behaviour of the exit air window. Shortly it can be established:

the comfort in winter conditions improves essentially.

the demand of heat energy (it should be especially emphasized that reference is not made expressly to the improvement of the k-value, but the demand of energy of the system) decreases nearly 20%. (In addition, the saving obtained from the drop in the inside air level).

The invention will be described in more detail in the following with reference to the accompanying drawings, wherein FIG. 1 shows in section a building having outer wall elements according to the invention.

FIG. 5 is a sectional view of another embodiment of the invention.

FIG. 6 is a sectional view along line VI—VI in FIG. 5.

FIG. 7 is a sectional view along line VII—VII in FIG. 5.

Figure 1:
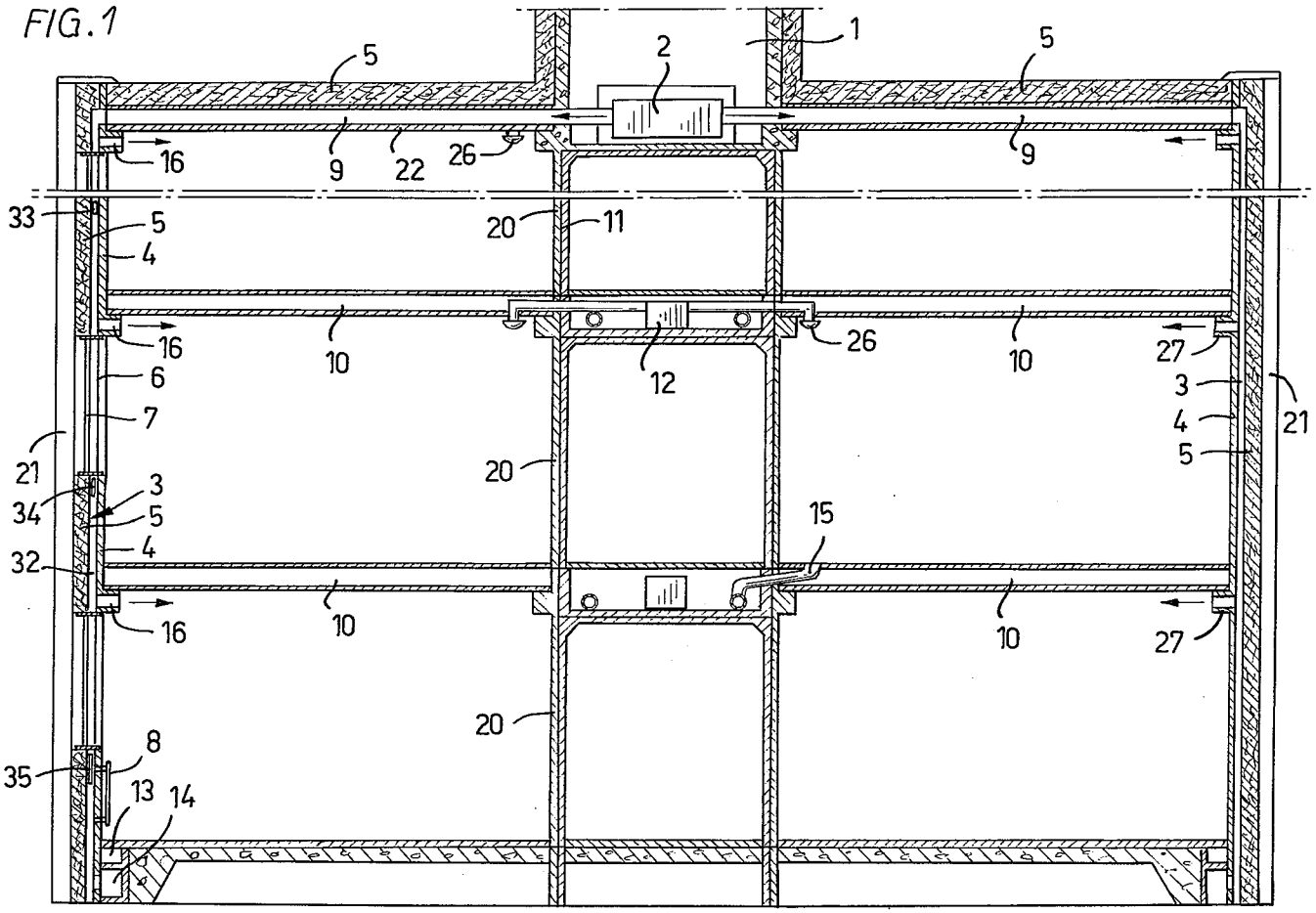
Figure 2:
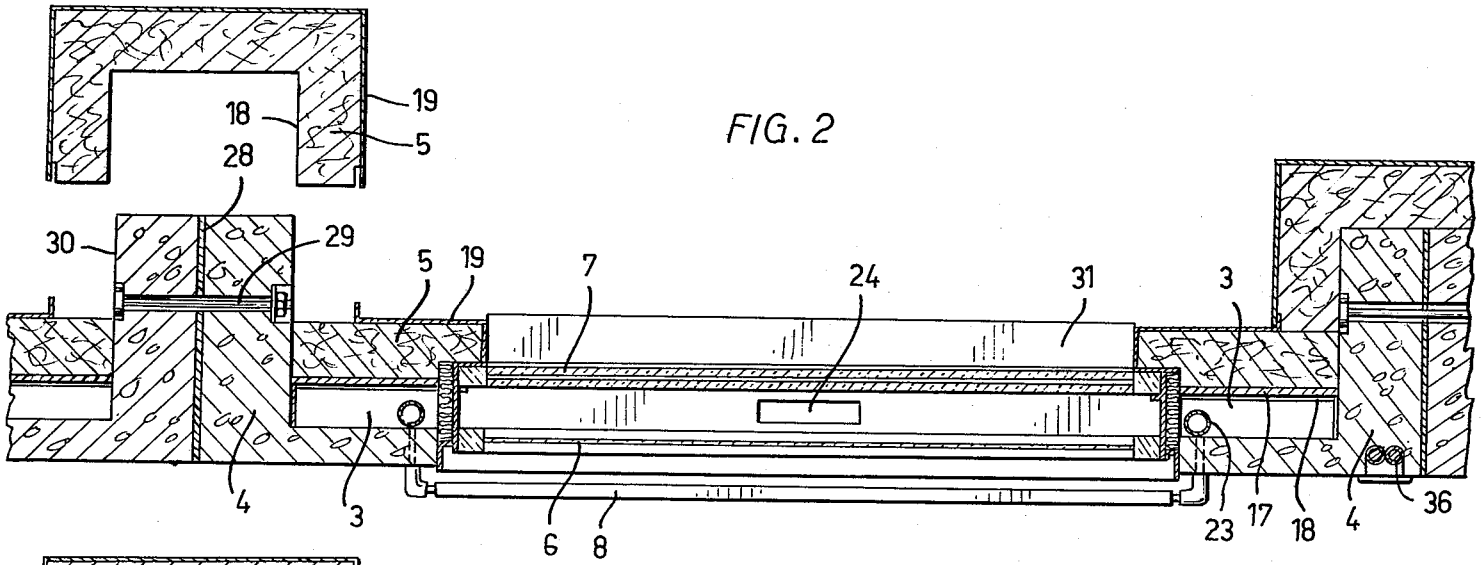
FIG. 2 shows a section through the element at a window.
Figure 4:
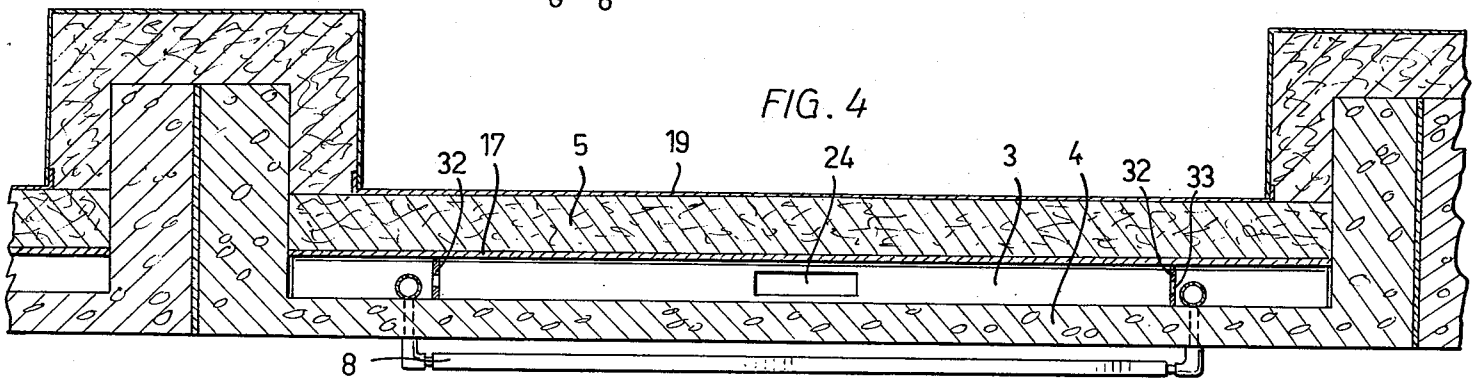
FIG. 4 shows a section through the element between the windows.
Figure 3:
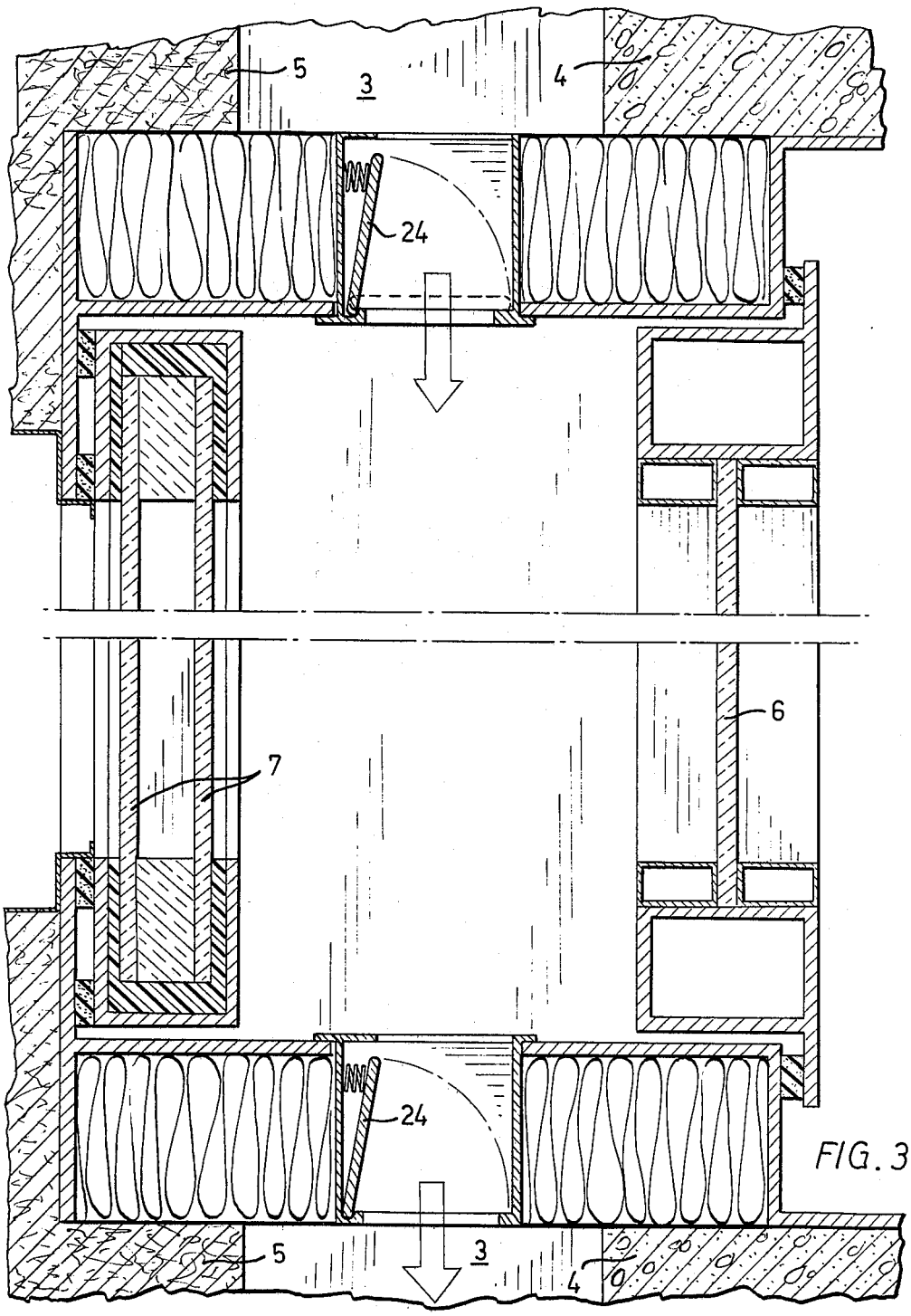
FIG. 3 shows in detail the construction of a window.

In the drawings reference number 1 marks the ventilation machine room which is arranged on the roof of a building where the outer walls are elements according to the invention. In the middle there is a corridor mast element 20, floor slab 10 and wall element 21, which is as high as the entire building. In the upper part of the building is arranged a warm air channel 2 running in the longitudinal direction of the building. Blow channels 9 running through a hollow slab 22 and conducting warm air into the warm air channels 3 of the wall elements diverge from the warm air channel 2. The supporting concrete portion 4 of the wall element remains inside the warm air channel 3, and fire shield and heat insulation 5 outside.

The windows in the wall element comprise an outer double sealed glass 7 and inner single glass 6. The inner glass 6 is advantageously tempered glass enduring fairly big mechanical stresses as well as heat stress. The warm air channel 3 is connected with the intermediate space between the window glasses 6 and 7 so that this space forms a portion of the heat channel 3 of the wall element.

The window frames are fire protected with mineral wool or in some other similar manner.

The window lintels and sills [upper and lower window frames] are provided with a fire plate 24 made of detachable aluminum cases closing automatically when the temperature rises to a certain limit.

If desired, radiator heating can also be combined with the system. Radiators are marked with reference number 8. Then the rising mains 23 of the radiator water emit heat to the air channel 3.

The warm air return channel is marked with reference numeral 14. Warm air can also be blown into the room space through channels 16. The channels 16 are preferably provided with adjustable valves and fire plates. Exhaust of stale air takes place through exit air channel 12. The sewerage is marked with reference number 15 and the channel for other pipes with number 13.

The wall element is constructed so that the massive concrete portion remains inside the air channel 3. Hereby the concrete stores heat in itself and thus serves as an equalizer of the temperature. It is also possible to interrupt the heating intermittently and to use the heat stored by the concrete, which it emits slowly.

Outside the warm air channel 3 is e.g. an asbestos-cement plate 17 covered with an aluminium diaphgram 18 or a plate of a similar material. Outside this, there is a rather thick, e.g. 15 cm, mineral wool heat insulation. The heat insulation again is covered with a profiled metal sheet 19 or similar. Electric cables are marked with reference number 36.

The channel 3 may by means of partition walls 32 be divided into parallel parts preferably running vertically. The thus formed parts communicate with each other through openings 33, 34 35 the size of which preferably grow larger down the element. The purpose of these openings is to regulate the energy flow in form of warm air to provde even heating in all stories, and may vary in size depending on the needs.

The window arrangement of the invention enables utilisation of sun energy for heating the air in the channel, on the other hand it prevents the heat of the sun beams from entering into the room which thus enables effective cooling in the summer.

Numeral 28 marks the joint between two wall elements joined together at protrusion 30 by means of bolts 29. 31 is the window plate and 36 electrical cables which may be preinstalled along the whole element.

Another embodiment of the element is shown in FIGS. 5, 6 and 7. The element is designated 40 and is shown as three stories high. At the top is seen the opening of a channel 41 for incoming air and the opening of a channel 42 for outgoing air. A continuous channel 43 runs from channel 41 down the element on one side of windows 44 and up on the other side of the windows to channel 42. In the part of channel 43 where fresh air is flowing downwards are arranged openings 45 through which air is fed into the rooms of the building. The space between windows of different stories are indicated 64.

The windows are connected to both parts of channel 43 through apertures in the side frames and in each window there is thus a flow of air in the space formed by the window panes, with the same effect as described before. By circulating the air in such a way even temperatures are obtained in all stories.

Figure 8:
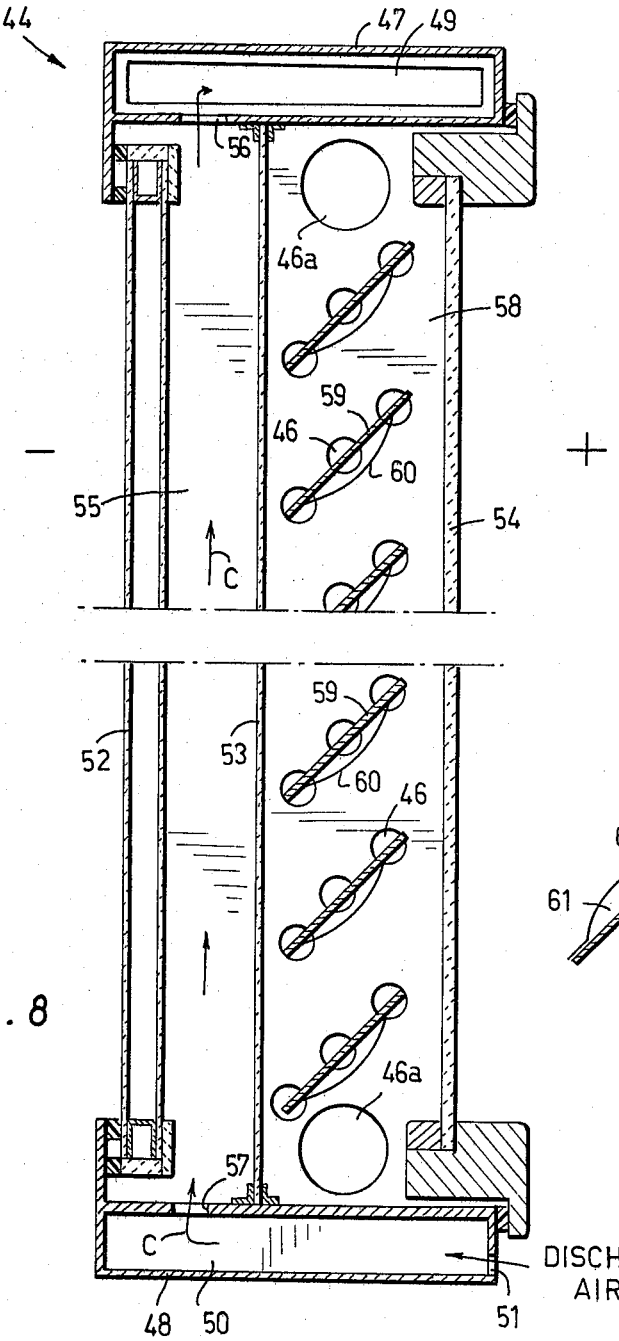
FIG. 8 is a vertical section of a window, taken along line VIII—VIII in FIG. 5.
Figure 9:
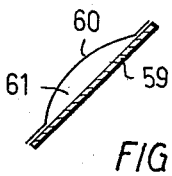
FIG. 9 shows from the side an accumulator element used in the window of FIG. 8.
Figure 10:
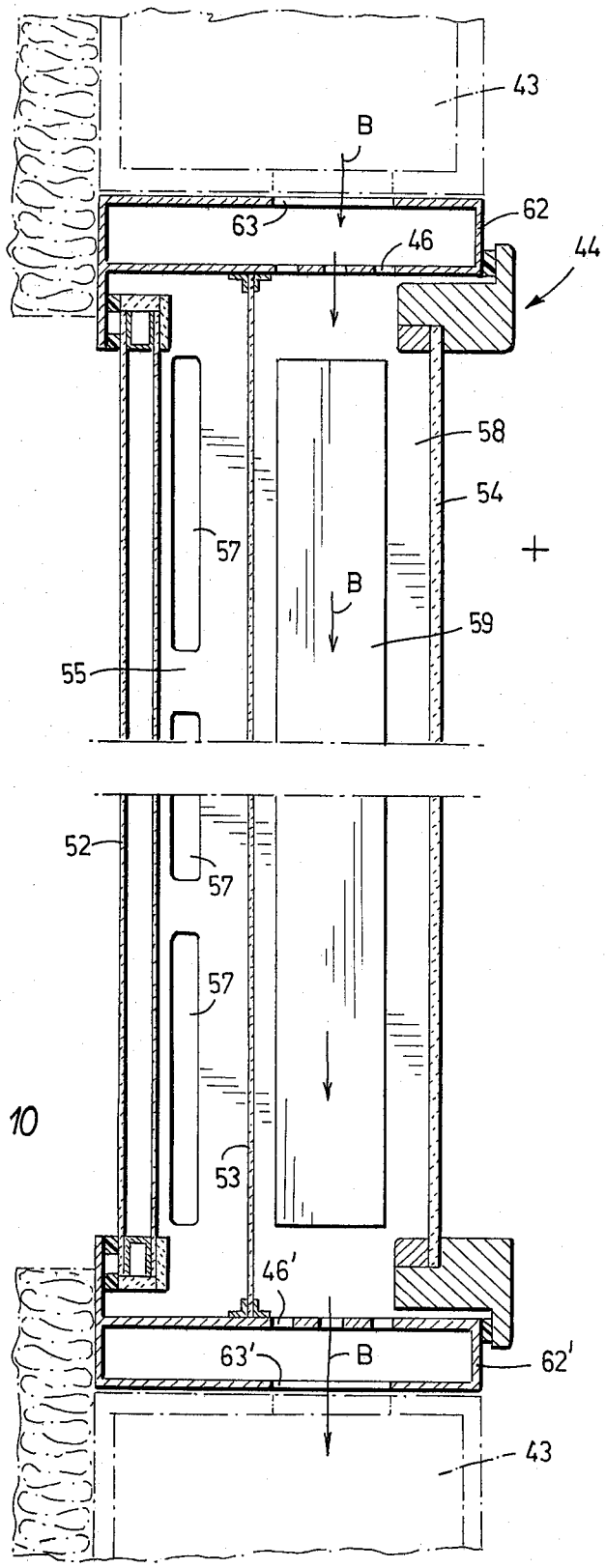
FIG. 10 is a horizontal section of a window, taken along line X—X in FIG. 5.

In FIGS. 8, 9 and 10 is shown a preferable embodiment of a window for use in the element according to the invention.

The upper frame of the window 44 is indicated 47 and the lower frame 48. Both frames have cavities 49 and 50 respectively, forming channels for discharge air from the room. The lower frame 48 has for this purpose an inlet 51 extending substantially over the whole width of the window. Channel 49 ends in the rising part of channel 43. The window has preferably three panes, outermost e.g. a double pane 52, an intermediate pane 53 of ordinary type and an inner pane 54, preferably of tempered glass, but may also be of ordinary glass. The space 55 between the panes 52 and 53 is connected with the cavities 49 and 50 in the upper and lower frames through apertures 56 and 57. The space 58 between the panes 53 and 54 communicates with the channel 43 through apertures 46 and 46'. In the space 58 is further arranged accumulator elements 59 which in FIGS. 8 and 9 are in the form of strips made e.g. of metal with good capability to absorb sun radiation heat. The form of the accumulator elements may vary greatly, they may e.g. have the form of round cells. The angular position of strips 59 is adjustable according to the needs. Each strip 59 is also provided with a reflector 60 for reflecting radiation from the strip back to the strip or alternatively to prevent radiation to reach the strip. As the reflector 60 reflects the heat radiation coming from the accumulator 59 back again the air space 61 is strongly heated. The position of the accumulator strips 5 may thus be altered in such a way that the absorbing surface is facing inwards to the room and the reflector 60 is facing outwards. This alternative makes it possible to effectively cool the room air during hot weather. Through the heat absorbing in accumulators 59 will then the temperature of the window fall considerably. The strips may be mounted in the channel 58, e.g. in the same way as as jalousie. The reflectors 60 can be fastened directly on the accumulators 59 or, as shown in FIGS. 8 and 9, in such a way that a space 61 is formed between the accumulator and the reflector. Apertures 46 are preferably arranged at the same levels as the accumulators 59, but their form and number may vary greatly, they might even be replaced by a continuous vertical slot e.g. with adjustable width. In the embodiment of FIG. 8, the larger apertures **46*a* are used as regulating means when regulating the speed of flow between different stories. As shown in FIG. 8 the accumulator elements are arranged in the inner channel 58 and the discharge air from the room is flowing in the outer channel 55**. In general this arrangement is preferred because the discharge flow then will function as a buffer between the outer air and the circulation air which will be better insulated from the outer air. In very hot climates the reverse arrangement may also be contemplated.

FIG. 10 shows the window as a horizontal section. The side frames 62 and 62' are preferably made of aluminum, but may naturally, as well as the upper and lower frames be of other material and connection from one side of channel 43 to the other is established through apertures 63 and 46, space 58 and apertures 46' and 63'.

The element 40 works in the following way:

Incoming air blown by a blowing unit not shown enters at 41, runs down the channel 43, whereby part of the flow enters the rooms through apertures 45 and part of the flow passes sideways through space 58 in the windows, a considerable part of the flow proceeding all the way down the element and up on the other side of the windows 44. The flow in channel 43 is indicated with arrows A and the part of the flow passing through the windows is indicated with arrows B. Apertures 46 are arranged in such a way with respect to the accumulator strips 59 that flow B effectively follows the surface of the strips whereby the air is heated. Flows A and B and through the apertures 45 may be regulated in manners known per se.

The flow of discharge air from the room is indicated by arrows C. Flow C enters the channel 50 in the lower frame 48 through the inlet 51 and continues through the aperture 57, channel 55, aperture 56, channel 49 out in the rising part of the main channel 43. In the channel 55 the discharge air transfers part of its heat to the circulation air through the glass 53.

By means of wall elements according to the invention it is possible to conveniently create a heating (or cooling) system where the whole building is surrounded by a regulated layer of air heating the building, transferring heat from the southern side of the building to the northern side thus distributing sun energy evenly throughout the building. The same system also airconditions the building and utilizes the cold at night for cooling purposes.

Especially during summer it is also possible to heat water by means of such a system. The accumulator elements in the windows produce a great deal of energy in form of heated air, the temperature of which may be further increased by means known per se, such as a heat pump, whereafter the heat is transferred to water in a central unit preferably situated on the roof of the building. The arrangement of the windows is the most important feature of the present invention enabling an effective utilization of sun energy to great benefit for the heating system as a whole.

Fresh air enters into the rooms through apertures 45 and discharge air flows out into channel 43 through space 55 in windows 44. To a great extent the superfluous heat inside the rooms is utilized in the windows and the rest of the heat is recovered in a central unit by means of heat exchangers. The discharge air may also be arranged to flow vertically from one story to another through the spaces 64 (FIG. 5), or from these spaces 64 into hollow floor elements. If desired, it is also possible to fill the spaces 64 with a heat absorbing material. The outgoing part of the channel 43, at right in FIG. 5, may be divided into a separate part for the discharge air from the rooms and electrical and other installations may also be placed in this separate part.

The heat balance between different stories can be regulated by regulating the quantities of warm air, or cool air, respectively, blown through the window channel.

The invention has been described above with reference to two preferred embodiments only of the invention. This must, however, not be considered as a restricting fact of the scope of protection of the invention, as the scope of protection of the invention will be defined in the following claims.

What I claim is:

1. An outer wall element for use in a building employing a central unit for air conditioning, with at least one window having at least two panes and with a height the same as the height of the building, comprising a concrete part and a heat insulating part, a continuous air channel running through the element from end to end and of a width substantially corresponding to the width of the element, the space between the window panes forming a part of the air channel, the inlet of said air channel being connected to a feed channel for cooling air or heating air, respectively, from the central unit and the outlet of said air channel being connected to a channel leading to the central unit for reuse of energy stored in the circulation air, and there being partition walls interconnecting the windows, the windows and the partitions walls dividing said air channel into a part for incoming fresh air and a part for outgoing air, the inlet for the fresh air and the outlet for the outgoing air being arranged at the same end of the wall element, and the fresh air part of the air channel and the outgoing air part of the air channel being in connection with each other at that end of the wall element which is opposite to the end having the inlet and the outlet and through the windows, the windows thus forming a part of the air channel.

2. An outer wall element according to claim 1, wherein said air channel further comprises outlets leading to the rooms.

3. An outer wall element according to claim 1, wherein the space between the window panes is divided into two separate parts by means of a third pane, a first of said two separate parts being for the blown air circulating in the wall element and the second part being for the room discharge air, and wherein means for absorbing heat radiation and for transferring heat to the air flowing through the window are arranged in at least one of said parts.

4. An outer wall element according to claim 3, wherein said heat absorbing means comprise metal accumulators provided on one side with a reflector for reflecting heat radiated from the metal accumulator back to said accumulator.

5. An outer wall element according to claim 4, wherein a channel is formed between each metal accumulator and its associated reflector.

6. An outer wall element for a building, the wall element being provided with at least one opening for a double glass window and having a height of at least one story of the building and comprising a concrete part and a heat insulating part, the element defining a continuous channel running through the element from end to end and of a width substantially corresponding to the width of the element, the space between the window glasses forming a part of the channel, and the channel being divided by thin partition walls into parallel vertical parts.

7. An outer wall element according to claim 6, wherein the different parallel parts of the channel communicate with each other through openings formed in said partition walls, said openings increasing in size when moving down the element.

8. An outer wall element for a building, the wall element being provided with at least one opening for a double glass window and having a height of at least one story of the building and comprising a concrete part and a heat insulating part, the element defining a continuous channel running through the element from end to end and of a width substantially corresponding to the width of the element, the space between the window glasses forming a part of the channel, and the window comprising a frame in which there are mounted a single glass between the channel and the room air and a double glass of good heat insulating capacity between the channel and the outer air, the frame being fire protected and including upper and lower parts provided with fire plates or the like.

* * * * *